US006065506A

United States Patent [19]

Scari et al.

[11] Patent Number: 6,065,506

[45] Date of Patent: May 23, 2000

[54] RAPIER LOOM THREAD GRIPPER WITH ELASTIC TONGUE

[75] Inventors: Diego Armando Scari; Marco Scari, both of Brugherio, Italy

[73] Assignee: Gividi-Italia S.p.A., Brugherio, Italy

[21] Appl. No.: 09/153,240

[22] Filed: Sep. 15, 1998

[30] Foreign Application Priority Data

Jul. 29, 1997 [CH] Switzerland ..... 97 1811

[51] Int. Cl.[7] ..... D03D 47/23

[52] U.S. Cl. ..... 139/448

[58] Field of Search ..... 139/448

[56] References Cited

U.S. PATENT DOCUMENTS

| | | | |
|---|---|---|---|
| 3,519,028 | 7/1970 | Golobart | 139/448 |
| 3,613,740 | 10/1971 | Geiger | 139/448 |
| 4,231,402 | 11/1980 | Merisio | 139/448 |
| 4,520,851 | 6/1985 | Rohr et al. | 139/448 |
| 4,632,152 | 12/1986 | Pezzoli . | |

FOREIGN PATENT DOCUMENTS

| | | |
|---|---|---|
| 0137377 | 4/1985 | European Pat. Off. . |
| 0504899 | 9/1992 | European Pat. Off. . |
| 600 003 | 6/1978 | Switzerland . |
| 625573 | 9/1981 | Switzerland . |

*Primary Examiner*—Andy Falik
*Attorney, Agent, or Firm*—Greenblum & Bernstein, P.L.C.

[57] ABSTRACT

A Clamp for a rapier loom having A hollow body with first and second ends. The first end is adapted to be fastened to a transporting tape of the rapier loom. A thread gripping hook is mounted on the second end of the hollow body. A movable element is mounted in the hollow body and movable between retracted and extended positions. A tongue has first and second ends. The first end is mounted on the hollow body and the second end is adjacent the gripping hook. The second end is separate from the hook when the moving element is in the retracted position, and in contact with the hook when the moving element is in the extended position. A resultant movement of the tongue is in a direction substantially perpendicular to a path of the movable element.

26 Claims, 3 Drawing Sheets f
l

RAPIER LOOM THREAD GRIPPER WITH ELASTIC TONGUE

BACKGROUND OF THE INVENTION

1. Field of the Invention

The present invention concerns a pulling clamp for rapier looms of the type described in the introductory part of the claim 1 of the present invention and a preferred application of the inventive clamp.

2. Discussion of Background Information

In the textile industry rapier looms are in use often competing with other loom types (such as shuttle looms, projectile or air jet weaving machines, etc.) for inserting the weft threads into the weaving shed.

One of the major problems with these weaving machine types is the transfer of the weft thread at the centre of the fabric from the carrying clamp to the pulling clamp which transfer always is a susceptible phase in the weaving process particularly if synthetic fibres are processed composed of very delicate fibrils which are easily torn and in particular threads of glass fibrils which resist tensite forces but break very easily. The problems are aggravated if the threads are low twist or twistless threads which are applied in the production of technical fabrics of the highest quality in which any torn fibril sticking out of the fabric surface is considered a serious defect which can depreciate the product considerably.

Considerable efforts already have been taken in the past for solving the problem by providing a good grip of the thread in the pulling clamp of a rapier loom while ensuring at the same time a gentle treatment of the thread material and, as far as possible, excluding any rupture of fibrils.

A first design of a pulling clamp with an elastic tongue blocking the thread is described in CH-A-625573 in which document a pulling clamp is described comprising a hook and a gripping tongue moving at right angles with respect to the plane of the damp which furthermore is characterized in that the gripping action of the tongue is reinforced by an additional gripping element. This clamp thus is equipped with a gripping tongue which performs a motion of gripping transversal with respect to the clamp, i.e. the thread is gripped by the clamp from the side. As admitted by the applicant of said patent application a thread gripping system of such type cannot ensure sufficient safety as the tongue can oscillate laterally relative to the clamp itself during the fast longitudinal displacement of the clamp and thus can free the thread. For this reason the pulling clamp described according to the invention is provided with an additional gripping element which can eliminate the oscillations of the gripping tongue and thus can prevent the thread from escaping from the clamp. This system of "laterally" gripping the thread still did not prove sufficiently subtle for gripping threads composed of very breakable fibrils, particularly glass fibrils, and thus other solutions were studied for better gripping action which take care of the particular requirements in connection with the processing of technical fabrics produced from particularly delicate threads, even of types presenting high tensile strength, such as glass fibres.

An essential improvement was proposed in EP-A-0137377 which represents the state of the art relevant for the present invention. In the patent application cited a pulling clamp is proposed provided with a plunger guided and activated in the body of the clamp in such a manner that it alternatingly performs to and fro movements. On said plunger an elastic tongue is fastened which thus performs to and fro movements together with the plunger. The elastic tongue in this arrangement with its gripping zone is pressed against the gripping surface of the hook by the plunger when the plunger is located in its most forward position in such a manner that the thread is blocked between the tongue and the hook.

According to a further improvement of this solution, describeded in EP-A-0504899, for improved contact between the gripping zone of the tongue—fixed solidly to the plunger—and the gripping surface of the hook it was proposed that the plunger in its zone in which it contacts the tongue be provided with a cushion or runner made from an elastic material, e.g. from rubber, the function of which is to improve the adherence between the tongue and the hook of the clamp and thus to improve the grip on the thread.

The disadvantage of the state of the art described in the two last-mentioned documents cited, the first of which is considered as the state of the art pertinent to the present invention, is seen in that the elastic tongue, if present, is fastened to the plunger and thus performs the to and fro motion with the latter. This implies that the thread is gripped between the gripping zone of the elastic tongue and the gripping surface of the hook in a "dragging" movement due to the superimposition of the longitudinal to and fro movement of the plunger and the one at right angles to the gripping surface caused by the plunger which presses the tongue laterally against the gripping surface of the hook. This dragging movement of the tongue, however, is very disadvantageous as it inevitably causes a rolling movement of the thread about its axis: the fibrils thus are dragged along the walls of the elastic tongue and of the hook and are damaged as well as displaced from their position in the thread structure. An increase of ruptures of individual fibrils is the consequence of a dragging movement of such type and a kind of a false twist zone is generated in the thread: both phenomena are undesirable, particularly the second one if twistless filaments are processed.

SUMMARY OF THE INVENTION

It thus is the objective of the present invention to completely eliminate the danger of rupture of fibrils during the phase of transfer, or giving off respectively, of the thread from the carrying clamp to the pulling clamp as well as any generation of false twist in the thread itself.

These objectives are achieved by means of a clamp of the type described in the introductory part of the present invention.

Owing to the fact that the elastic tongue is firmly fastened to the body of the clamp and that the tongue is pressed against the gripping surface by the plunger with a movement essentially at right angles relative to the gripping surface of the hook elimination of any longitudinal component of the relative movement between the tongue and the gripping surface of the hook is achieved and thus any dragging movement or friction of the tongue and/or of the gripping surface on the body exerted onto the thread is excluded: the fibrils thus are not forced to drag against the corresponding walls nor to rub against each other which eliminates any danger of rupture of fibrils.

On the other hand it is to be stressed that the systems in which longitudinal plungers are applied in practical use have proven superior by far in comparison to the ones operating with levers pivoting about a transverse shaft for reasons which are not cited in more detail here. The rapier looms today use pulling clamps with longitudinal plungers for gripping the thread and already for this reason this solution appears to be the most favourable in practical weaving operations whereas the solutions without plungers can be considered obsolete and no longer are in practical use. In fact it is a also an objective of the present invention to be able to apply the inventive pulling clamp on a major number of rapier looms available on the market without excessive modifications on these looms.

Special forms of realisations are apt to stress in special manner the ease of adaptation of the inventive arrangement to the specific properties of the thread (linear density, number of fibrils per cross-section, quality of the material extruded, etc.) as well as the advantages off the longer life of the gripping zones owing to the absence of any dragging movement between the thread—which can present strongest abrasive properties such as in the case of glass fibres—and the gripping surfaces, or as also called clamping surfaces often.

Finally the claim 9 concerns a preferred application of the inventive clamp which is particularly suitable for weaving glass fibre fabric, in particular with twistless threads.

BRIEF DESCRIPTION OF THE DRAWINGS

The invention is described in the following in more detail with reference to various examples of embodiments illustrated in the corresponding Figures. It is shown in the.

DETAILED DESCRIPTION OF THE EXEMPLARY EMBODIMENT

Figure 1:
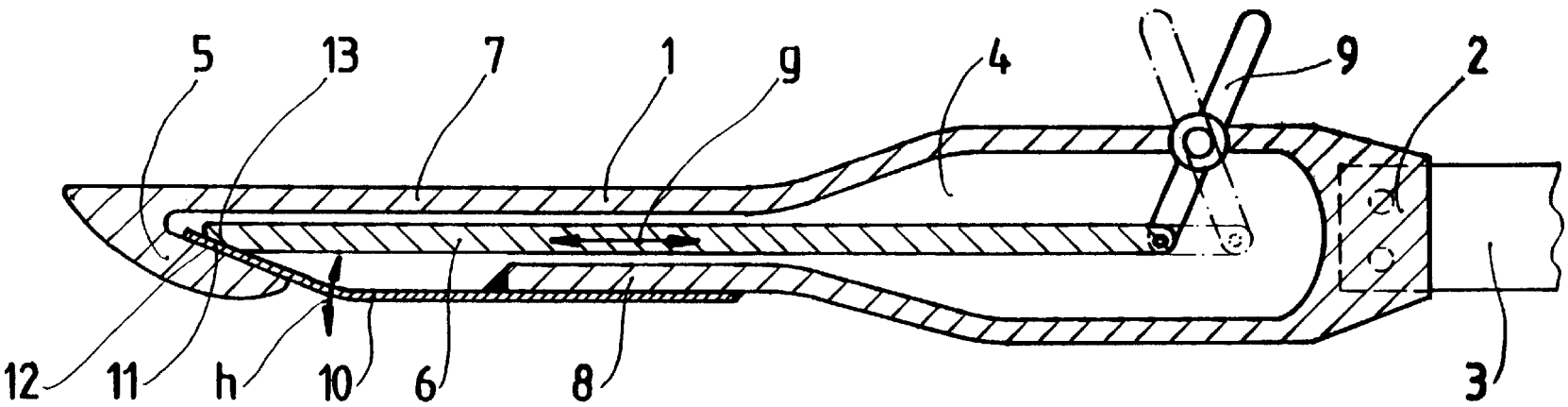
FIG. 1 The inventive pulling clamp shown with its most important components seen in a top view and with the thread in its gripped position, FIG. 2 A top view of a first alternative design example representing an improvement of the inventive clamp shown in its open position.

In the FIG. 1 showing the inventive clamp in a top view with just the elements essential for realising the invention shown in their simplest form possible; the body designated 1 comprises a solid terminal portion 2 to which the transporting tape 3 is fastened using suitable means indicated summarily only, a hollow centre portion 4 in which the gripping elements to be described in the following are located, and a front or hook portion 5 forming the thread gripping zone. The body 1 of the clamp must be as light as possible as it is a rapidly reciprocating mass moved by the tape 3 and thus normally is made from a light alloy, e.g. from aluminium, and provided with walls designed as thin as possible.

Within the hollow portion 4 the plunger or pushing element 6 is arranged consisting of a thin metallic rod guided longitudinally between the lateral walls 7 and 8 of the clamp body 1 which at its zone nearest to the hook 5 narrows in such a manner that it forms a guide element in which the plunger 6 can perform its to and fro movements relative to the body 1 as indicated by the double arrow g.

The mechanism inducing the to and fro movement of the plunger 6, and thus the closing and opening of the clamp for the thread, is known in practice and thus is indicated in symbolic manner merely in the FIG. 1 with an oscillating lever linked to the plunger 6 and pivotably mounted on the body 1.

On the lateral wall 8 of the body 1 of the clamp, i.e. the wall opposite the open side of the hook 5 an elastic tongue 10 is mounted onto the clamp, more precisely said tongue 10 is fastened with its end opposite its gripping zone in such a manner that the free end of the tongue 10 can oscillate freely performing small lateral movements indicated by the double arrow h which bring the gripping zone 11 of the tongue 10 into contact with the gripping surface 12 of the hook 5. In the FIG. 1 the clamp is shown in its closed position in which the plunger 6 is pushed forward by the actuating mechanism 9 towards the point of the hook 5 and thus presses its front portion 13, which preferably is rounded, against the inner surface of the gripping zone 11 of the tongue 10: the latter thus is pushed with a forward movement according to the arrow h (i.e. counterclockwise in the FIG. 1) against the gripping surface 12 of the hook 5 forming a gripping zone for the thread (not shown). The plunger 6 (shown in an analogue form in the FIG. 2) being in its retracted position the tongue owing to its pretension separates itself from the gripping surface 12 of the hook 5 and thus frees the gripped or pinched thread. The present invention essentially is characterized in that in a clamp provided with a plunger moving longitudinally the elastic tongue 10 which is solidly fixed to the body of the damp 1 (e.g. soldered, as shown in the FIG. 1 in purely schematic manner or using other suitable means to be described in the following) performs only a movement substantially at right angles relative to the gripping surface 12 of the hook 5 as indicated by the double arrow h. The thread being gripped in this movement is not dragged in any way along the wall of the gripping zone 11 of the tongue 10 nor against the gripping surface 12 of the hook 5 and thus can not suffer any damages due to such dragging movements described already in the introduction.

Figures 2, 3, 4:
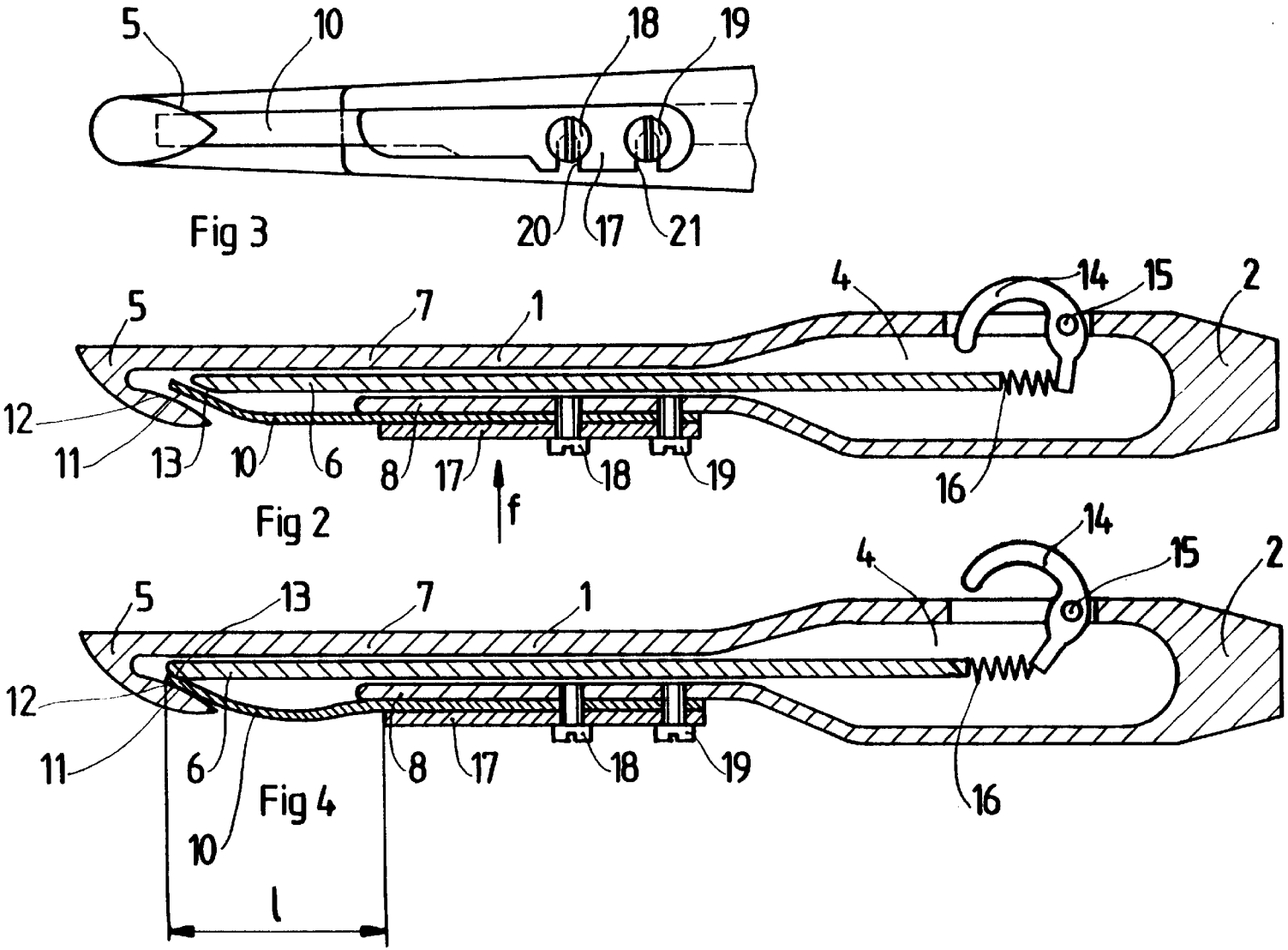
FIG. 3 The front portion of the clamp according to the FIG. 2 seen in the direction of the arrow f according to the FIG. 2, FIG. 4 The clamp according to the FIG. 2 seen in the same direction but in its closed position with the thread gripped, FIG. 5 An enlarged top view of the point of the inventive clamp showing two further alternative design examples of the invention, and in the FIG. 6 A view similar to the one shown in the FIG. 5 of a further alternative design example of the invention.

In the FIGS. 2 through 4 showing the inventive pulling clamp in various situations and in different views also several improvements of the inventive idea are shown. In these Figures the elements corresponding to the ones shown in the FIG. 2 are referred to using the same reference numbers.

The clamp shown in the FIG. 2 with the plunger 6 in its retracted position it can be seen that the elastic tongue 10 owing to its pre-tension is separated from the gripping surface 12 of the hook 5 in such a manner that the thread is freed at the end of the weft thread. In the FIG. 2 it can be seen furthermore that in this position the curved lever 14 activating the plunger 6 has rotated counterclockwise about its rotational axle 15 and that the lever 14 actuates the plunger 6 via a spring 16 the purpose of which is to dampen the impact of the plunger 6 on the elastic tongue 10.

In the solution shown in the FIGS. 2 through 4 it can be seen also in which manner, in order to better influence the elasticity of the elastic tongue 10, the tongue is solidly fixed to the body I of the clamp, in particular to the lateral wall 8 of the body 1, by means of a support member 17 pressing the portion of the tongue 10 nearest to the point of fixation (effected in the example shown using screws 18 and 19 which will be described in the following) against the body 1 of the clamp. Evidently the free and flexible zone of the tongue 10 can be rendered more or less rigid by correspondingly choosing the dimensions of the support member 17, in particular the distance 1 of its end from the front end of the tongue 10 (see the FIG. 4) and its thickness, in such a manner that the elasticity properties in the gripping zone can be influenced to adapt the gripping characteristics to the properties of the thread processed. This is very important if extremely delicate and fine fabrics are to be woven.

A further alternative embodiment of the present invention, also shown in the FIGS. 2 through 4, the objective of which also is the possibility of influencing the grip of the elastic tongue 10 exerted onto the thread and of fastening the elastic tongue 10 and/or the support element 17 (in the preferred case of application of a similar element) to the body 1 of the clamp using at least two screws 18 and 19, and that the tongue 10 and/or the support element 17 are provided with fixation slots 20, 21 for facilitating the interchangeability of the tongue 10 and/or the support member 17. This solution permits fast exchange of the elastic tongue 10 and/or the support member 17 and easy adaptation of the gripping characteristics of the clamp.

Figure 5:
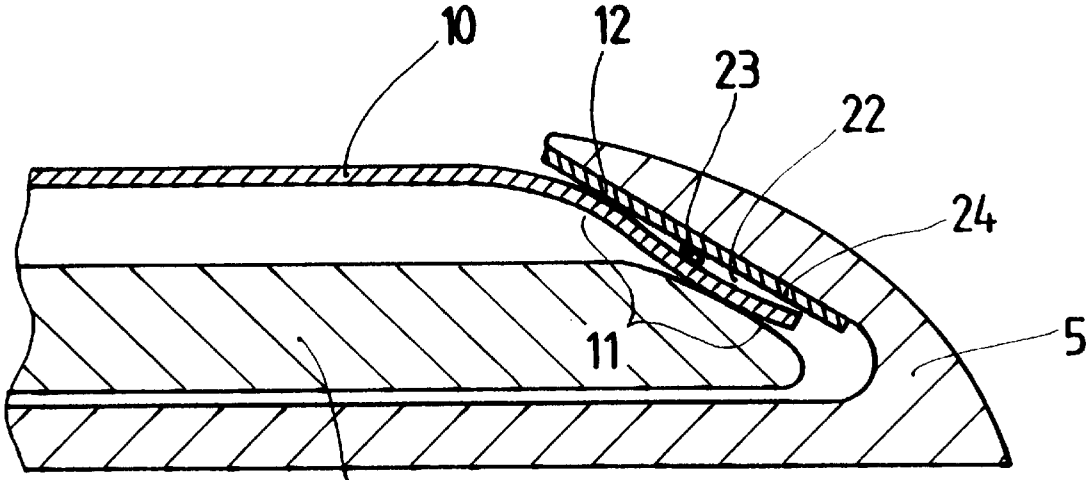

According to another preferred embodiment of the present invention, illustrated in the FIG. 5 showing the gripping zone of the clamp in an enlarged view, the elasticity of the elastic tongue 10 in its thread gripping zone 11 is chosen to permit local deformation in its longitudinal direction in such a manner that with the gripping surface 12 of the hook 5 it forms a space closed by both sides 22 within which all the fibrils of the thread 23 are closed in. By closing in all fibrils of the thread 23 in a closed space 22 the fibrils located at the margin of the thread are prevented from breaking or straying off and thus from leaving the gripping zone during the fast clamp movement from the centre to the edge of the fabric, which otherwise could occur if not the whole cross-section of the thread is closed in in a closed space and individual fibrils are more or less free to separate from the thread surface and to escape from the hook 5.

Obviously for obtaining the effect shown in the FIG. 5 refined studies are required of the elastic properties of the gripping zone 11 of the tongue 10 based also on practical experiments.

In the FIG. 5 another embodiment of the inventive solution is shown in which the gripping surface 12 of the hook 5 of the clamp is formed as a small plate 24 made of suitable material fastened to the corresponding zone of the hook 5. Owing to the application of a small plate made from suitable material, in particular made from a very wear-resistant material, the life span of the clamp can be beneficially influenced and also the wear of the material of the hook 5 itself can be prevented. By replacing the wear parts of the hook 5, especially the small plate 24, the clamp life span is rendered virtually unlimited as the actual thread gripping zone is the zone most subject to wear.

Furthermore the application of the solution using the interchangeable small plate 24 permits realisation of another preferred embodiment of the present invention, namely the one in which the gripping zone 11 of the tongue 10 and/or the gripping surface 12 are provided with suitable surface roughness characteristics for improving the grip on the thread without damaging the fibrils. Such roughness can be established on said surface, or surfaces respectively by providing suitable simple or crossed grooves, i.e. zones alternatingly heightened and sunken in which can be generated using many different means of physical or chemical treatment.

Figure 6:
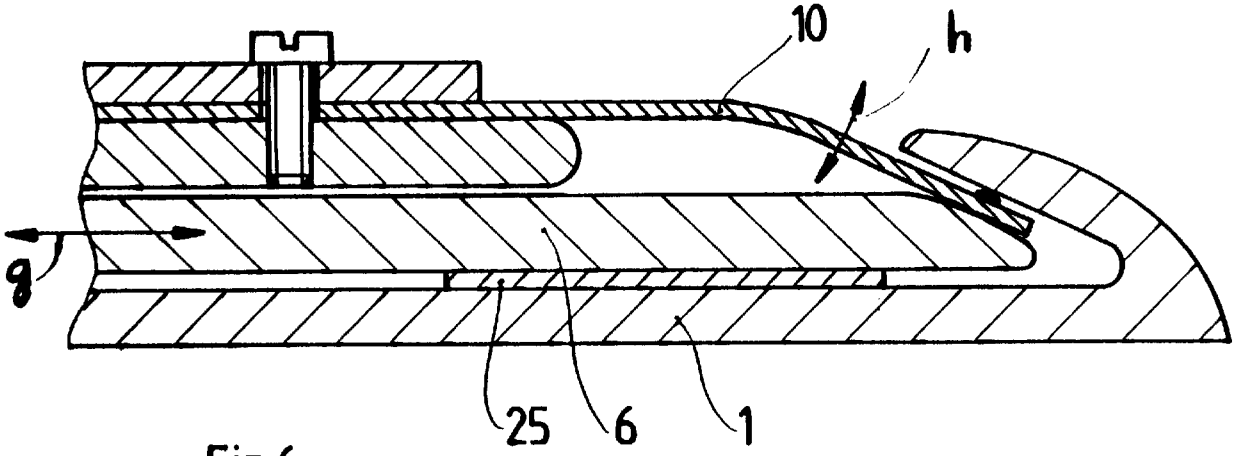

In the FIG. 6 another alternative embodiment of the present invention is shown in which between the plunger 6 and the body 1 of the clamp, on the side opposite to the side on which the elastic tongue 10 is arranged, an exchangeable element 25 of a certain thickness is inserted for adapting the play between the plunger 6 and the body 1 of the clamp, or the wall 7 of the damp respectively, if the FIGS. 1 through 4 are referred to. The advantage of this solution is seen in that also the effect of wear on the functional tolerances of the plunger 6, which are rather tight, can be compensated for. Whenever the play of the plunger 6 in its guide element in the clamp body becomes excessive due to wear, the functional tolerance required for proper function of the clamp can be narrowed again by inserting an element of suitable thickness, i.e. ideal thread gripping conditions between the elastic tongue 10 and the hook 5 can be established again.

From practical experience it was found that he elastic tongue 10 presents ideal elasticity conditions if it is made from spring steel and is of a thickness of 0.1 to 0.5 mm: these are the dimensions for a normal pulling clamp made fro aluminium of the type generally used in practical weaving operations.

The pulling clamp for rapier looms which is the object of the present invention has proven ideal for application on looms used for processing very delicate synthetic fibres or glass fibre threads, in particular in low twist or twistless threads. Applications of this type represent extremely demanding application on rapier looms as processing of glass fibre threads and especially of low twist or twistless threads is, as any expert in the field knows, one of the most difficult problems in weaving, the individual fibrils being extremely brittle in the sense that they cannot be bent in excess of a certain limit, and that in a low twist or twistless thread they tend to separate from each other providing very little cohesion to the thread. The inventive clamp on the other hand permits gripping also threads of such types very gently without breaking the fibrils but at the same time with great reliability preventing the individual fibres from escaping the grip and from causing problems of breakage of fibrils.

What is claimed is:

1. Pulling clamp for rapier looms, comprising:

an elongated body of the clamp adapted to be fastened at one of its ends to the transporting tape of the rapier and provided at its other end with a thread gripping hook;

a plunger guided and actuated in the body of the clamp in such a manner that it alternatingly performs to and fro movements in the longitudinal direction relative to the body; and an elastic tongue of elongated shape arranged parallel to the plunger between the plunger and a gripping surface of the hook, the elastic tongue having a thread gripping zone formed thereon that is pressed against the gripping surface of the hook by the plunger when the plunger is in its most forwardly extended position to secure a thread between the tongue and the hook;

wherein the elastic tongue is solidly fastened to the body of the clamp at its end opposite its thread gripping zone and is pressed by the plunger against the gripping surface in a movement of its gripping zone essentially at right angles relative to the longitudinal direction.

2. Pulling clamp according to the claim 1, wherein the tongue is solidly fastened to the body of the clamp using a support element, wherein dimensions of said support element influence the elasticity of the tongue in its gripping zone.

3. Pulling clamp according to the claim 2, wherein fastening of the elastic tongue and/or of the support element to the body of the clamp are, or is respectively, effected by means of at least two screws and that the tongue and/or the support element are, or is respectively, provided with fixation slots for the fastening screws facilitating the removal of the tongue and/or of the support element.

4. Pulling clamp according to the claim 1, wherein the elastic tongue in its thread gripping zone is provided with an elasticity permitting local deformation in its longitudinal direction in such a manner that together with the gripping surface of the hook it forms a space closed on both sides within which all the fibrils of thread are enclosed.

5. Pulling clamp according to the claim 1, wherein the gripping surface of the hook of the clamp is formed by a small plate fastened to the hook of the clamp.

6. Pulling clamp according to the claim 1, wherein the gripping zone of the elastic tongue and/or the gripping surface of the hook are, or is respectively, provided with surface roughness characteristics which improve the gripping of a thread without damaging the thread.

7. Pulling clamp according to the claim 1, wherein between the plunger and the body of the clamp, on a portion opposite to the one on which the elastic tongue is arranged, an interchangeable element is inserted for adjusting the play between the plunger and the body of the clamp, which can compensate for the effect of wear onto the functional tolerances of the plunger.

8. Pulling clamp according to the claim 1, tongue is made from spring steel and is of a thickness ranging between 0.1 and 0.5 mm.

9. A pulling clamp for a rapier loom, comprising:

a hollow body having a first end adapted to be fastened to a transporting tape of said rapier loom, and a second end;

a thread gripping hook on said second end of said hollow body;

a movable element mounted in said hollow body and movable between retracted and extended positions;

a tongue having a first end mounted on said hollow body and a second end adjacent said gripping hook; and said second end of said tongue being separate from said hook when said moving element is in said retracted position, and in contact with said hook when said moving element is in said extended position, wherein a resultant movement of said tongue is in a direction substantially perpendicular to a path of said movable element.

10. The pulling clamp of claim 9, further comprising a support element connecting said tongue to said body, the size and shape of said support element influencing an elasticity of said second end of said tongue.

11. The pulling clamp of claim 10, wherein at least one of said support element and said tongue have first and second fixation slots, and first and second screws connect said at least one of said support element and said tongue to said body through said first and second fixation slots, respectively.

12. The pulling clamp of claim 9, wherein said hook and said second end of said tongue can grip a thread therebetween when said movable element is in said extended position.

13. The pulling clamp of claim 9, wherein a portion of said hook adjacent said second end of said tongue has a plate mounted thereon, said plate defining a gripping surface for gripping a thread.

14. The pulling clamp of claim 9, wherein at least a portion of at least one of said hook and said tongue have a roughed surface which can grip a thread without damaging the thread.

15. The pulling clamp of claim 9, wherein said tongue is made from spring steel and has a thickness ranging between 0.1 and 0.5 mm.

16. The pulling clamp of claim 9, wherein an interchangeable element is disposed between said movable element and said body, on a side of said body opposite said tongue, said interchangeable element having a thickness which sets play between said movable element and said body.

17. A pulling clamp in combination with a rapier loom, comprising:

a rapier loom;

a hollow body having a first end adapted to be fastened to a transporting tape of said rapier loom, and a second end;

a thread gripping hook on said second end of said hollow body;

a movable element mounted in said hollow body and movable between retracted and extended positions;

a tongue having a first end mounted on said hollow body and a second end adjacent said gripping hook; and said second end of said tongue being separate from said hook when said moving element is in said retracted position, and in contact with said hook when said moving element is in said extended position, where a resultant movement of said tongue is in a direction substantially perpendicular to a path of said movable element.

18. A method for gripping a thread in a pulling clamp, said pulling clamp including a hollow body having a first end adapted to be fastened to a transporting tape of a rapier loom, and a second end, a thread gripping hook on said second end of said hollow body, a movable element mounted in said hollow body and movable between retracted and extended positions, and a tongue having a first end mounted on said hollow body and a second end adjacent said gripping hook, said method comprising:

separating said tongue from said hook by moving said movable element to said retracted position;

inserting at least one thread between said hook and said tongue;

clamping said at least one thread between said hook and said tongue by moving said movable element to said extended position; and moving said tongue, during said separating and said clamping, in a resultant direction that is substantially perpendicular to a path of said movable element.

19. The method claim 18, further comprising providing a support element connecting said tongue to said body, the size and shape of said support element influencing an elasticity of said second end of said tongue.

20. The method of claim 19, further comprising providing at least one of said support element and said tongue having first and second fixation slots, and first and second screws to connect said at least one of said support element and said tongue to said body through said first and second fixation slots, respectively.

21. The method of claim 18, further comprising gripping a thread between said hook and said second end of said tongue when said movable element is in said extended position.

22. The method of claim 18, further comprising providing a portion of said hook adjacent said second end of said tongue having a plate mounted thereon, said plate defining a gripping surface for gripping a thread.

23. The method of claim 18, further comprising providing at least a portion of at least one of said hook and said tongue having a roughened surface which can grip a thread without damaging the thread.

24. The method of claim 18, further comprising providing said tongue as a spring steel having a thickness ranging between 0.1 and 0.5 mm.

25. The method of claim 18, further comprising disposing an interchangeable element between said movable element and said body, on a portion of said body opposite said tongue, said interchangeable element having a thickness which sets play between said movable element and said body.

26. The method of claim 18, further comprising providing a rapier loom, and using said pulling clamp in combination with said rapier loom.

* * * * *